US007703367B1

(12) United States Patent
Bayless

(10) Patent No.: US 7,703,367 B1
(45) Date of Patent: Apr. 27, 2010

(54) VEGETABLE CUTTING DEVICE FOR PRODUCING INTERLOCKING SHAPED CONSUMABLE VEGETABLE OBJECTS

(76) Inventor: Lee Alan Bayless, 13800 SE. 44th St., Choctaw, OK (US) 73020

( * ) Notice: Subject to any disclaimer, the term of this patent is extended or adjusted under 35 U.S.C. 154(b) by 287 days.

(21) Appl. No.: 11/820,925

(22) Filed: Jun. 21, 2007

Related U.S. Application Data

(60) Provisional application No. 60/817,568, filed on Jun. 29, 2006.

(51) Int. Cl.
*B26F 1/02* (2006.01)

(52) U.S. Cl. ..... 83/687; 83/932

(58) Field of Classification Search ..... 83/932, 83/687, 691; 99/544, 557
See application file for complete search history.

(56) References Cited

U.S. PATENT DOCUMENTS

| | | | | |
|---|---|---|---|---|
| 2,835,294 | A * | 5/1958 | Rigney | 99/544 |
| 3,434,517 | A * | 3/1969 | Durand Jr. et al. | 99/544 |
| 3,608,413 | A * | 9/1971 | Borello | 83/133 |
| 4,216,712 | A * | 8/1980 | Altman | 99/565 |
| 5,102,678 | A | 4/1992 | Plant | |
| 5,363,756 | A | 11/1994 | Muro | |
| 5,582,096 | A | 12/1996 | Marton | |
| 6,736,041 | B2 | 5/2004 | Portnoy | |
| 7,096,771 | B2 | 8/2006 | Mendenhall | |
| 2007/0125216 | A1 * | 6/2007 | Wuensch | 83/649 |

* cited by examiner

*Primary Examiner*—Kenneth E. Peterson
(74) *Attorney, Agent, or Firm*—Randal D. Homburg

(57) ABSTRACT

A vegetable cutting device producing shaped vegetable products which can be attached and assembled to form shaped objects allows adults or children to assemble the various shaped vegetable products to promote an interest in a child consuming fresh raw vegetables in the form of edible toys. The counter or table top cutting device provides a cutting base, and a spring activated safety push plate and a plurality of interchangeable cutting surfaces and pressing templates to cut the vegetables into the several shapes, primarily carrots, celery, radishes, potatoes, broccoli, or other raw nutritional solid fruits or vegetables.

1 Claim, 6 Drawing Sheets

VEGETABLE CUTTING DEVICE FOR PRODUCING INTERLOCKING SHAPED CONSUMABLE VEGETABLE OBJECTS

CROSS REFERENCE TO RELATED APPLICATIONS

Applicant claims the benefit of Provisional Patent Application Ser. No. 60/817,568 filed Jun. 29, 2006.

I. BACKGROUND OF THE INVENTION

1. Field of Invention

A vegetable cutting device producing shaped vegetable products which can be attached and assembled to form shaped objects allows adults or children to assemble the various shaped vegetable products to promote an interest in a child consuming fresh raw vegetables in the form of edible toys. The counter or table top cutting device provides a cutting base, and a spring activated safety push plate and a plurality of interchangeable cutting surfaces and pressing templates to cut the vegetables into the several shapes, primarily carrots, celery, radishes, potatoes, broccoli, or other raw nutritional solid fruits or vegetables.

2. Description of Prior Art

The following United States patents were discovered and are disclosed within this application for utility patent. All relate to vegetable and fruit cutting devices.

In U.S. Pat. No. 5,102,678 to Plant, an apparatus cuts a potato into a heart shaped core or by splitting the potato after which the opposing sections are scooped out or blades laterally flex to carve out a cavity when the shaft is rotated. The parts are not adapted to be interconnected to form an object. A table top slicing device cuts fruit or vegetables into multiple wedges and drops the pieces into a container below the cutting device in U.S. Pat. No. 5,363,756 to Muro. An automated device disclosed in U.S. Pat. No. 5,582,096 to Marton, peels, cores and shapes vegetables in to certain football shaped objects by multiple cuts to the vegetable and multiple blades working consecutively to form the vegetable objects. Scoop shaped pieces are formed by use of the cutting blade assembly disclosed in U.S. Pat. No. 7,096,771 to Mendenhall by a singular fixed blade array as the vegetable is forced through the blade array.

None of the objects disclose a plurality of blade sets which form vegetable objects out of several different raw vegetables which can be assembled to form a shaped object as does the present invention. Herein lies the novelty of the present vegetable cutting device.

II. SUMMARY OF THE INVENTION

Parents often have a difficult time with enticing their children into eating health snacks, especially fresh raw vegetables and fruits. Unhealthy snacks are preferred and these snack foods promoters utilize advertising campaigns which make these snacks appealing to youth by associating fun themes to promote their sale and consumption. Raw vegetables and fruit are not "fun" foods, and thus lack the appeal of prepared snack foods loaded with fats, calories, artificial flavor enhancers, sugar and preservatives. Most unhealthy snack foods also lack vitamins, nutrients and fiber not found in fresh fruits and vegetables. The present vegetable cutting device attempts to make raw vegetables more fun and appealing by providing the device to cut the raw vegetables and fruit into shaped pieces that enable a child or parent to create shaped objects which may appeal to children and encourage them to eat the pieces or objects.

The primary objective of the device is to provide a table top embodiment to allow an adult to cut raw vegetables or fruits into shaped pieces which can be connected and assembled to form shaped objects to entice children to eat the raw vegetable and fruit pieces while they play with them. As secondary objective of the device is to provide the device with a plurality of interchangeable blade assemblies to form a variety of different shaped pieces using a series of cutting surfaces.

III. DESCRIPTION OF THE DRAWINGS

The following drawings are submitted with this utility patent application.

FIG. 8 is an embodiment of a shaped object made from shaped vegetable pieces using the cutting device and the various plates and templates of FIGS. 1-7.

IV. DESCRIPTION OF THE PREFERRED EMBODIMENT

Figure 1:
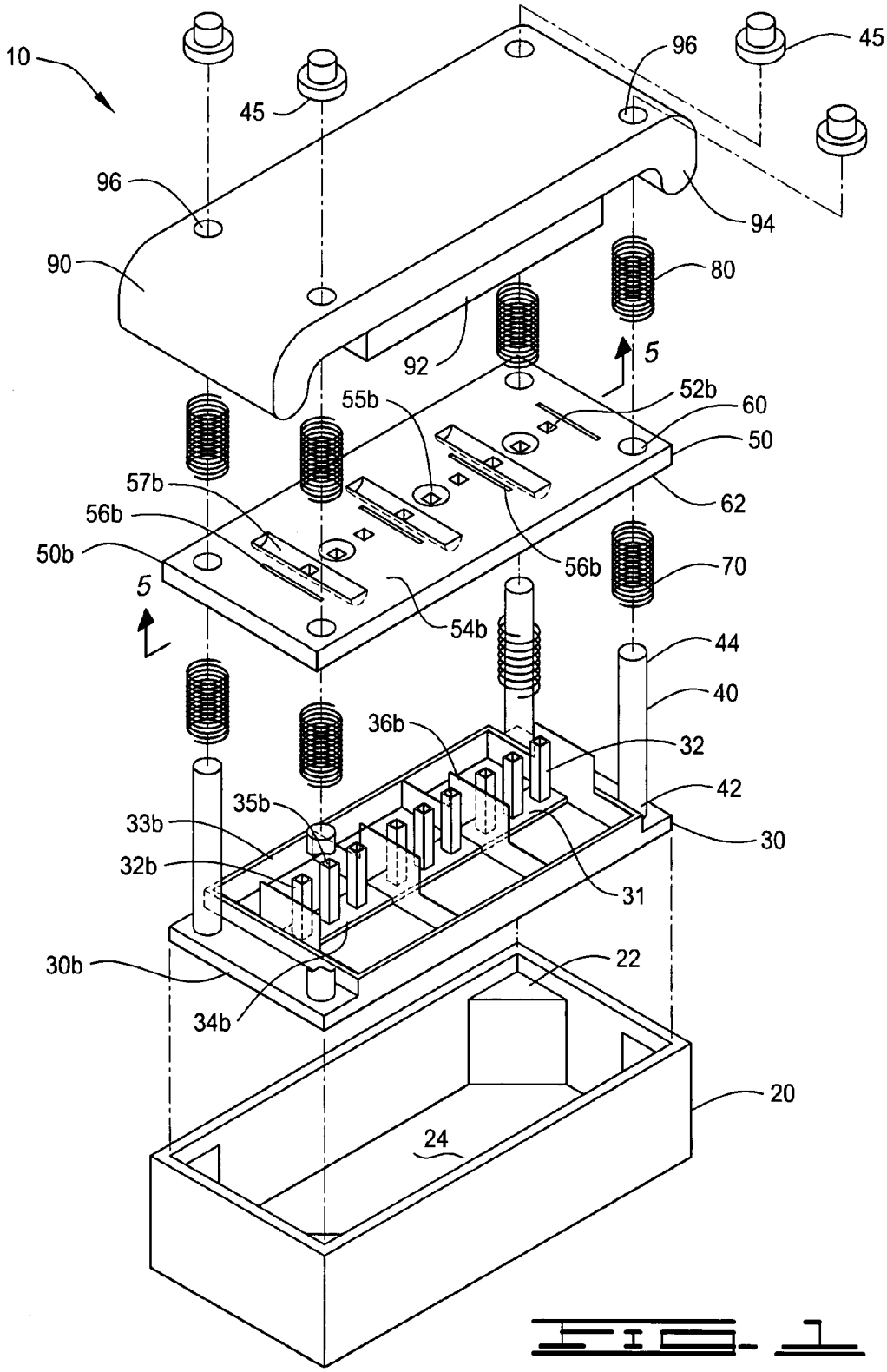
FIG. 1 is an expanded upper perspective view of the cutting device showing the lower linear punch plate and the upper linear punch template.
Figure 2:
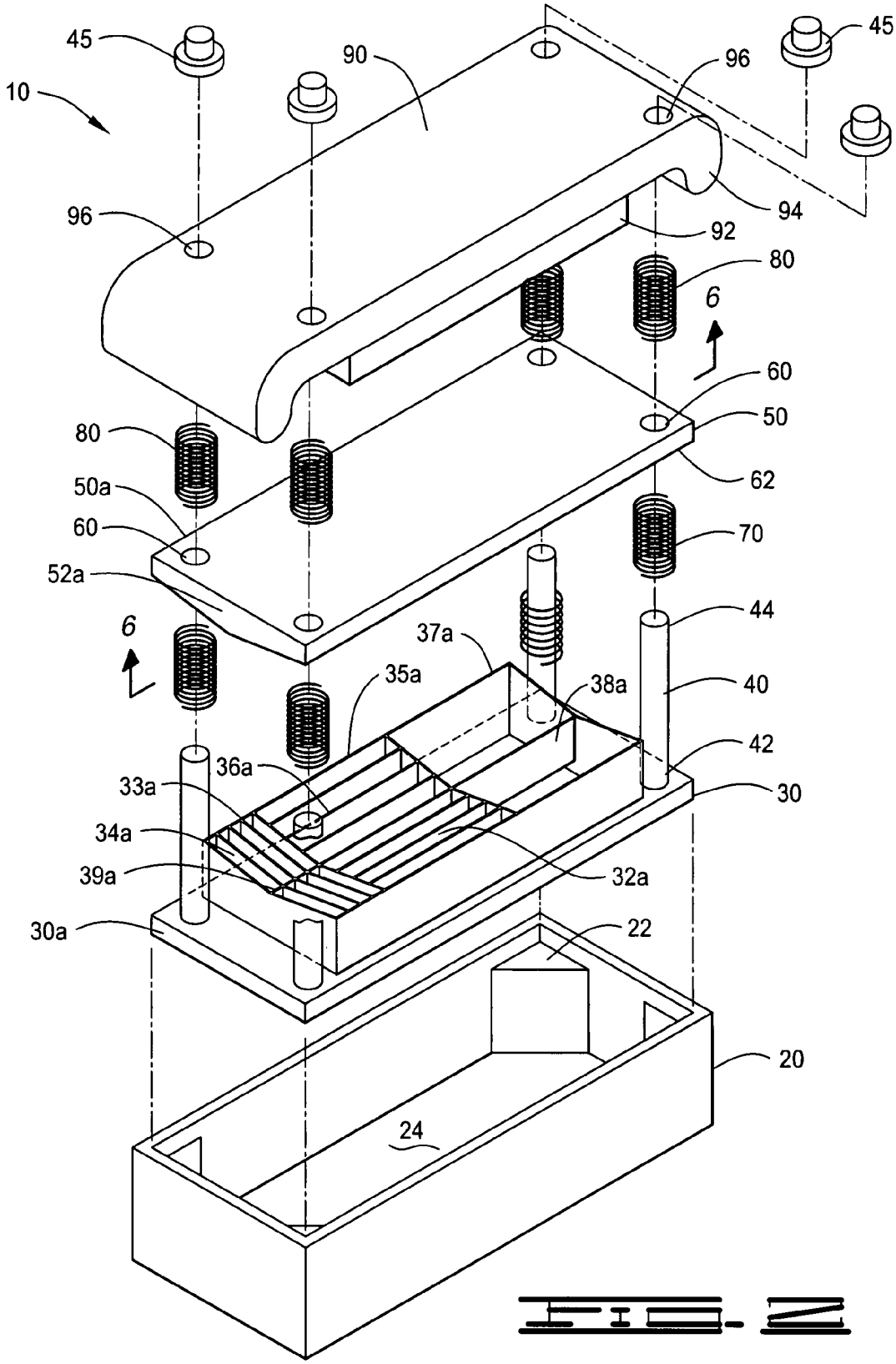
FIG. 2 is an expanded upper perspective view of the cutting device showing the lower sectional cutting plate and the upper sectional cutting template.

A vegetable cutting device 10, shown in FIGS. 1-7 of the drawings, provides counter top cutting of raw fruits or vegetables into shaped pieces 100 which may be interconnected and assembled to form a shaped object 200, the device 10 comprising a base receptacle member 20 having a plurality of lower plate supports 22 and defining a cavity 24, at least one lower plate 30 set upon the lower plate supports 22 within the base receptacle member 20, the lower plate 30 having an upper surface 31 defining a cutting means 32 and a plurality of upward projections 40 having lower ends 42 attached to the lower plate 30 and adapted to slidably receive a plurality of apertures 60 in an upper template 50, the upper template 50 having a lower surface 62 adapted to receive the cutting means 62 of the lower plate 30, a first set of coil springs 70 applied to each upward projection 40 above the lower plate 30 to urge the upper template 50 above the lower plate 30 in parallel, an upper push plate member 90 having a lower surface 92, a pair of outer safety handles 94 and plurality of apertures 96 slidable engaging the upward projections 40, a second set of coil springs 80 applied to each upward projection 40 above the upper template 50 to urge the upper push plate member 90 above the upper template 50, and a set of upward projection locking caps 45 applied to an upper end 44 of each of the plurality of upward projections 40 wherein the shaped pieces 100 of raw fruit or vegetable are formed by placing the raw fruit or vegetable between the upper template 50 and the lower plate 30 or between the upper template 50 and the lower surface 92 of the upper push plate member 90 and pressing the upper push plate member 90 towards the base receptacle member 20 forcing the lower surface 92 of the upper push plate member 90 against the upper template 50 and the upper template 50 against the lower plate 30 cutting the raw fruit or vegetable.

The lower plate 30 and upper template 50 may be provided in several distinct paired embodiments, as shown in FIGS. 1-7. In a first embodiment, shown in FIGS. 2 and 6, the lower plate 30 is a lower sectional cutting plate 30*a* and the corresponding upper plate 50 is an upper sectional cutting template 50*a*. The lower sectional cutting plate 30*a* is further disclosed as having a plurality of vertical parallel blades 32*a* with a first end 33*a* and second end 37*a* defining a linear trough portion 39*a*, the first end 33*a* having a set of disk cutting blades 34*a*, a central portion 35*a* having a set of squared stick cutting blades 36*a*, and the second end 37*a* having a single linear cutting blade 38*a*. The upper sectional cutting template 50*a* has a central protruding section 52*a*, shown in FIG. 6, and provides a plurality of linear grooves 54*a* which allow a portion of each vertical parallel blade 32*a* to penetrate to completely cut through any raw fruit of vegetable placed between the lower sectional cutting plate 30*a* and the corresponding upper sectional cutting template 50*a* when used in the cutting device 10, providing the vegetable pieces as cross-cut flat disks 102, half cylindrical lengths 103, or square sticks 104, as shown in a shaped object 200 in FIG. 8.

Figure 5:
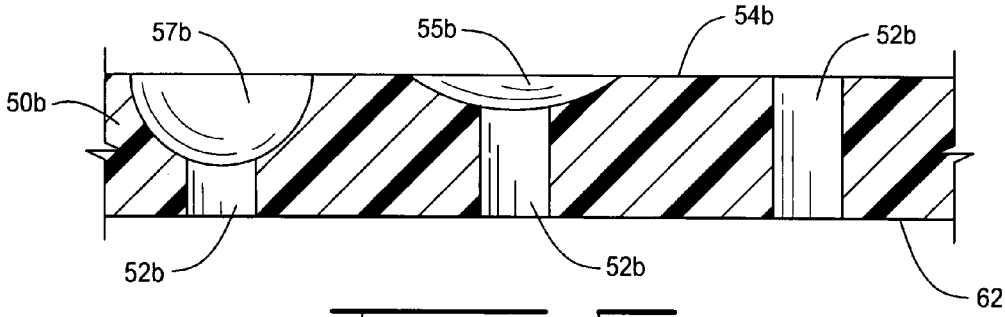
FIG. 5 is a cross-sectional view of the upper linear punch template along section lines 5/5 of FIG. 1.
Figure 6:
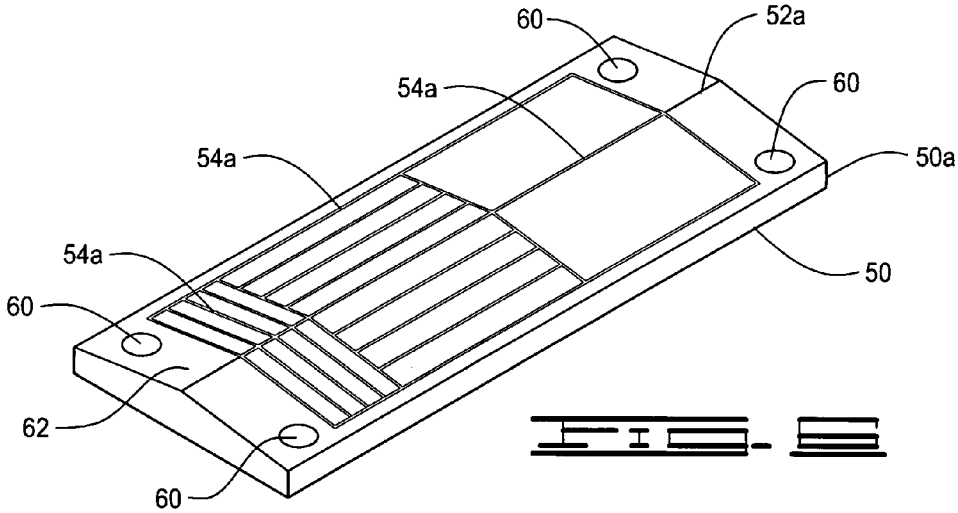
FIG. 6 is a lower perspective view of the upper sectional cutting template along section lines 6/6 of FIG. 2.

In a second embodiment, shown in FIGS. 1 and 5, the lower plate 30 is a lower linear punch plate 30*b* and the upper template 50 is an upper linear punch template 50*b*. The lower linear punch plate 30*b* is further disclosed as having an outer frame 33*b* with a central linear support plate 34*b* having a plurality of upward extending square coring blades 32*b*, each coring blade 32*b* having a hollow center portion 35*b*. The support plate 34*b* also includes at least one upward extending transverse sectional blade 36*b*. The corresponding upper linear punch template 50*b* provides a plurality of coring apertures 52*b*, each coring aperture 52*b* accepting an upward extending square coring blade 32*b*, and at least one transverse sectional aperture 56*b* adapted to receive the at least one transverse sectional blade 36*b* from the lower linear punch plate 30*b*. The upper linear punch template 50*b* has an upper surface 54*b* with at least one concave circular depression 55*b* adapted to receive a spherical vegetable or fruit 101 surrounding at least one of the plurality of coring apertures 52*b* and at least one concave trough depression 57*b* adapted to receive a section of half cylindrical shaped raw fruit or vegetable 103 around another coring aperture 52*b*. The lower linear punch plate 30*b* and the upper linear punch template 50*b* are used to pierce a raw fruit or vegetable and cut the fruits or vegetables into uniform length sections when placed between the upper surface 54*b* of the upper linear punch template 50*b* and the lower surface 92 of the upper push member 90 to remove at least one squared orifice 105 in each piece of fruit or vegetable adapted to receive a squared end of another shaped piece of fruit or vegetable, as shown in the shaped object 200 in FIG. 8.

Figure 3:
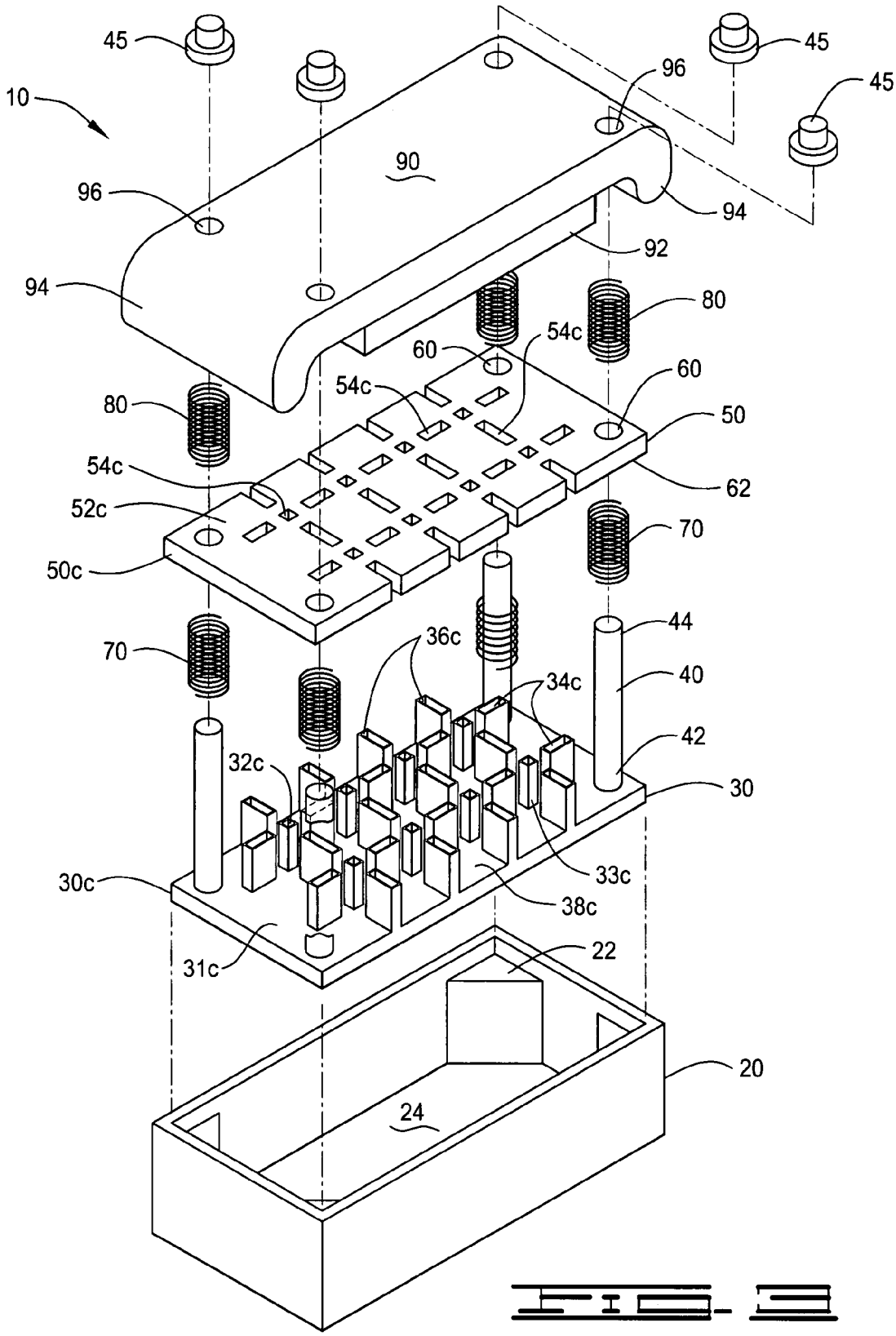
FIG. 3 is an expanded upper perspective view of the cutting device showing the lower cross-linear punch plate and the upper cross-linear punch template.

In a third embodiment, shown in FIG. 3, the lower plate 30 is a lower cross-linear punch plate 30*c* and the upper template 50 is an upper cross-linear punch template 50*c*. The lower cross-linear punch plate 30*c* is further disclosed as having a base plate 38*c* defining an upper surface 31*c* with at least one set of upward extending cross-linear coring blades 32*c*, each set of upward extending cross-linear coring blades 32*c* including a central square coring blade 33*c*, a first pair of aligned rectangular coring blades 34*c*, one on each side of the central square coring blade 33*c*, and a second pair of aligned rectangular coring blades 36*c*, one on each side of the central square coring blade 33*c* and positioned perpendicular to the first pair of aligned rectangular coring blades 34*c*. The upper cross-linear punch template 50*c* includes an upper surface 52*c* and a plurality of shaped apertures 54*c* adapted to receive each central square coring blade 33*c* and each first and second pair of aligned rectangular coring blades 34*c*, 36*c*, when the lower cross-linear punch plate 30*c* engages the upper cross-linear punch template 50*c* and the lower surface 92 of the upper push plate member 90. The upper cross-linear punch template 30*c* and lower cross-linear punch plate 50*c* are used to provide perimeter cut sections 106 to a raw fruit or vegetable disk 102 placed on the upper surface 52*c* of the upper cross-linear punch template 50*c* and below the lower surface 92 of the upper push plate member 90 which were previously cut by the lower sectional cutting plate 30*a* and the upper sectional cutting template 50*a*, the perimeter cut sections 106 adapted to receive other shaped raw fruit or vegetable pieces, as shown in the shaped object 200 in FIG. 8.

Figure 4:
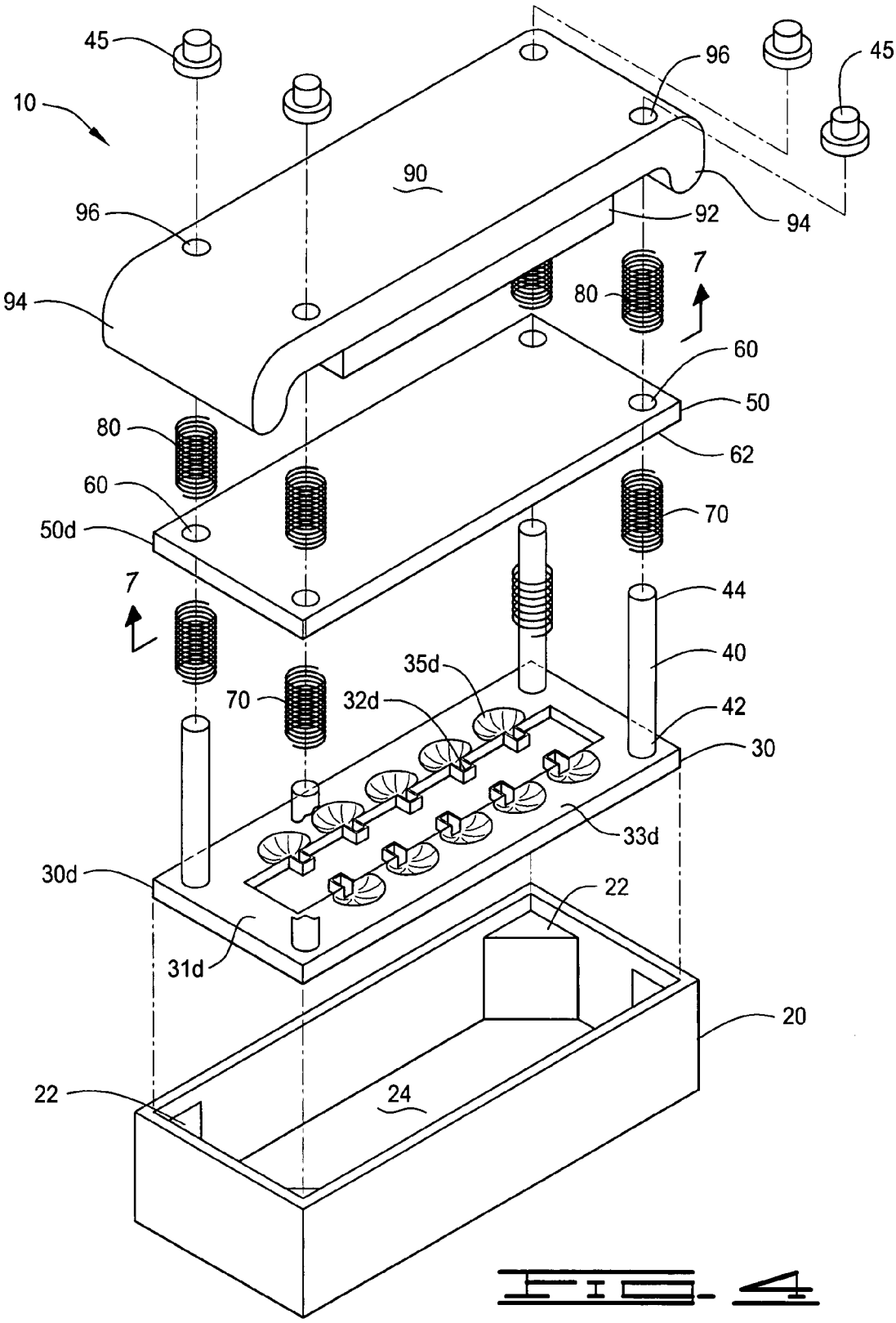
FIG. 4 is an expanded upper perspective view of the cutting device showing the lower stem cutting plate and the upper stem cutting template.
Figure 7:
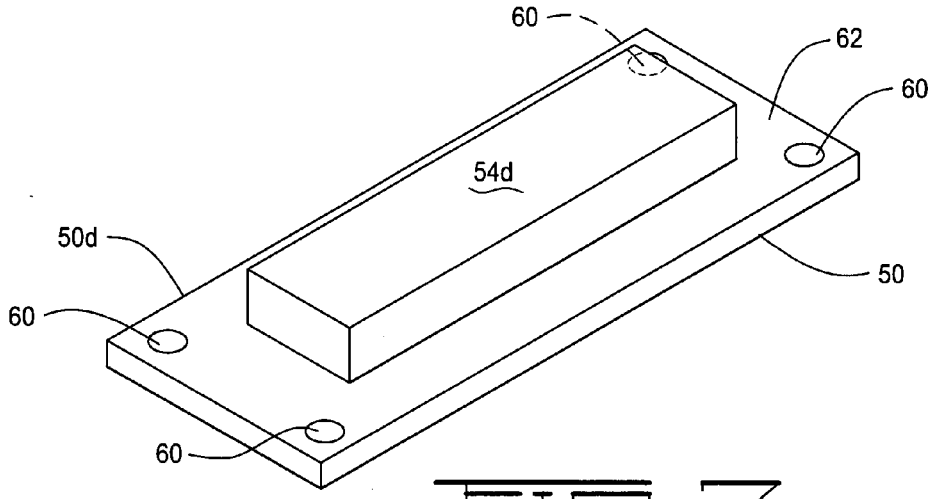
FIG. 7 is a lower perspective view of the upper stem cutting template along section lines 7/7 of FIG. 4.
Figure 3:
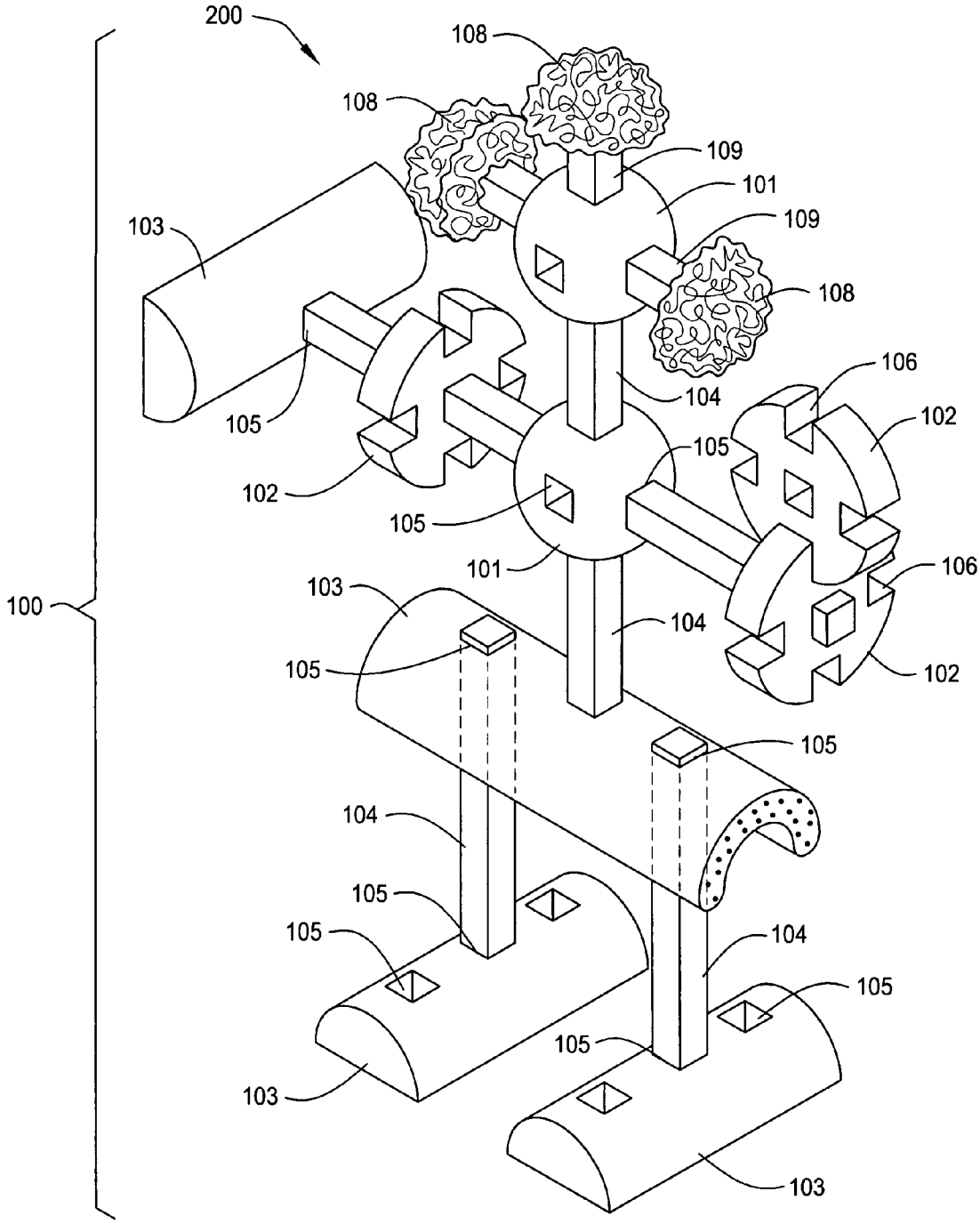

A fourth embodiment, shown in FIGS. 4 and 7, the lower plate 30 is a lower stem cutting plate 30*d* and the upper template 50 is an upper stem cutting template 50*d*. The lower stem cutting template 30*d* further defines an upper surface 31*d* comprising a lower frame segment 33*d* defining a plurality of floret shaped concave cutout segments 35*d* each having an inward extended squared stem blade portion 32*d*. The upper stem cutting template 50*d* further defines the lower surface 62, shown in FIG. 7, having a floret stem protrusion 54*d* adapted to be pressed against each square stem blade portion 32*d* in the lower stem cutting plate 30*d* when the lower stem cutting plate 30*d* is urged against the upper stem cutting template 50*d*. The upper stem cutting template 50*d* and lower stem cutting plate 30*d* are used to provide the stem of a floret shaped raw vegetable 108, primarily broccoli or cauliflower, with a square shaped perimeter stem 109 which may be inserted within a square orifice 105 of another raw fruit or vegetable resulting from the use of the lower linear punch plate 30*b* and upper linear punch template 50*b* or the lower cross-linear punch plate 30*c* and the upper cross-linear punch template 50*c*, as indicated in the shaped object 200 in FIG. 8.

While the cutting device 10 and the various upper plates 50, 50*a*, 50*b*, 50*c*, 50*d*, and lower templates 30, 30*a*, 30*b*, 30*c*, 30*d*, are represented in the drawing figures and having certain relative sizes and shapes, it is not the intention of the representative drawing figures to restrict the size or shape of the cutting device 10 and its components. As example, the base receptacle member 20 is drawn as being a rectangular object. However, the base receptacle member 20 may be circular, square or of any shape, with the upper plate 50 and lower templates 30 being of suitable shapes to mate with the shape of the base receptacle member 20. As another example, the upward projections 40 in the lower plates 30 are indicated as four in number, the upward projections 40 may number three or more, provided these upward projects 40 provide support for the movements required by the multiple members slidably engaging the upward projections in light of the forces required to cut the raw fruits or vegetables and they equal the number and placement of the respective upper templates 50 and upper push plate member 90. In addition, other upper templates 50 and lower plates 30 may be provided to conduct other cutting and shaping procedures to raw fruits and vegetables which may form shaped pieces which may be assembled including jigsaw pieces, cartoon character pieces, faces, outline figures or action heros.

Also, although represented as a table top embodiment, the cutting device 10 may also be presented in a fully automated device which would provide a series of cuts as a vegetable is placed on a conveyor system, not shown, which would provide multiple series cuts to produce large quantities of shaped pieces of raw fruits or vegetables for the commercial production of the shaped pieces of raw fruits or vegetables.

While the invention has been particularly shown and described with reference to a preferred embodiment thereof, it will be understood by those skilled in the art that changes in form and detail may be made therein without departing from the spirit and scope of the invention.

What is claimed is:

1. A vegetable cutting device for counter top cutting of raw fruits or vegetables into shaped pieces which are further interconnected and assembled to form a shaped object, said cutting device comprising:

a base receptacle member having a plurality of lower plate supports and defining a cavity;

a lower linear punch plate defining an outer frame with a central linear support plate having a plurality of upward extending square coring blades, each coring blade having a hollow center portion and at least one upward extending transverse sectional blade; and an upper linear punch template defining a plurality of coring apertures, each coring aperture accepting an upward extending square coring blade from said lower linear punch plate and at least one transverse sectional aperture adapted to receive said at least one upward extending transverse sectional blade from said lower linear punch plate, said upper linear punch template also defining an upper surface with at least one concave circular depression adapted to receive a spherical vegetable or fruit, said at least one circular depression surrounding at least one of said plurality of coring apertures and at least one concave trough depression adapted to receive a section of half cylindrical shaped raw fruit or vegetable, said at least one concave trough surrounding at least one said coring aperture, wherein said lower linear punch plate and said upper linear punch template are used to pierce a raw fruit or vegetable and cut said fruit or vegetables into uniform sections placed between said upper surface of said upper linear punch template and said lower surface of said upper push member to remove at least one squared orifice in each piece of fruit or vegetable adapted to receive a squared end of another shaped piece of fruit or vegetable;

a first set of coil springs applied to each upward projection above said lower plate to urge said upper template above said lower plate in parallel;

an upper push plate member having a lower surface, a pair of outer safety handles and a plurality of apertures adapted to slidably engage said upward projections;

a second set of coil springs applied to each upward projection above said upper template to urge said upper push plate member above said upper template plate; and a set of upward projection locking caps applied to an upper end of each of said plurality of upward projections, wherein said shaped pieces of raw fruit or vegetable are formed by placing said raw fruit or vegetable between said upper template and said lower plate or between said upper template and said lower surface of said upper push plate member and pressing said upper push plate towards said base receptacle member forcing said lower surface of said upper push plate against said upper template and said upper template against said lower plate cutting said segment of raw fruit or vegetable.

* * * * *